US007525086B2

(12) United States Patent
Suzuki

(10) Patent No.: US 7,525,086 B2
(45) Date of Patent: Apr. 28, 2009

(54) SPRAY GLOW DISCHARGE IONIZATION METHOD AND SYSTEM

(75) Inventor: Shigeru Suzuki, Yokohama (JP)

(73) Assignees: Japan Science and Technology Agency, Kawaguchi-shi (JP); National Institute for Environmental Studies, Tsukuba-shi (JP)

( * ) Notice: Subject to any disclaimer, the term of this patent is extended or adjusted under 35 U.S.C. 154(b) by 220 days.

(21) Appl. No.: 10/575,107

(22) PCT Filed: Nov. 21, 2003

(86) PCT No.: PCT/JP03/14864

§ 371 (c)(1),
(2), (4) Date: Apr. 10, 2006

(87) PCT Pub. No.: WO2005/036584

PCT Pub. Date: Apr. 21, 2005

(65) Prior Publication Data

US 2007/0120066 A1 May 31, 2007

(30) Foreign Application Priority Data

Oct. 10, 2003 (JP) ..... 2003-352086

(51) Int. Cl.
*H01J 27/04* (2006.01)

(52) U.S. Cl. ..... 250/288; 250/423 R; 250/424; 250/425

(58) Field of Classification Search ..... 250/288, 250/423 R, 424, 425
See application file for complete search history.

(56) References Cited

U.S. PATENT DOCUMENTS 4,546,253 A * 10/1985 Tsuchiya et al. ..... 250/288

(Continued)

FOREIGN PATENT DOCUMENTS

JP 59-35347 2/1984

(Continued)

OTHER PUBLICATIONS

Suzuki, et al ("A New Ionization Method for the LC/MS of Wastes and Related Compounds," Japan Society for Environmental Chemistry, pp. 764-765, 2003.*

(Continued)

*Primary Examiner*—Jack I. Berman
*Assistant Examiner*—Michael Maskell
(74) *Attorney, Agent, or Firm*—Oblon, Spivak, McClelland, Maier & Neustadt, P.C.

(57) ABSTRACT

An in-spray glow discharge ionization method and apparatus are provided The in-spray glow discharge ionization apparatus has a supply port supplying a fluid containing a compound to be measured, a gas blowing port which surrounds the supply port and which blows a gas exhibiting Penning effect to nebulize the fluid supplied from the supply port, a ground-side discharge electrode provided at a generation port at which the nebulized flow is generated, and a voltage application-side discharge electrode which is disposed in the traveling direction of the nebulized flow and opposed to the ground-side discharge electrode. In this in-spray glow discharge ionization method, while the fluid is nebulized by a spray gas (1), components of the compound to be measured which constitutes the fluid are ionized by the excited spray gas (1) exhibiting Penning effect, so that measurement is performed by a mass spectrometer.

19 Claims, 10 Drawing Sheets

U.S. PATENT DOCUMENTS

| | | | | |
|---|---|---|---|---|
| 5,192,865 | A * | 3/1993 | Zhu | 250/288 |
| 6,124,675 | A * | 9/2000 | Bertrand et al. | 315/111.91 |
| 7,112,785 | B2 * | 9/2006 | Laramee et al. | 250/288 |

FOREIGN PATENT DOCUMENTS

| | | | |
|---|---|---|---|
| JP | 02-135655 | | 5/1990 |
| JP | 2135655 | A * | 5/1990 |
| JP | 6-310091 | | 11/1994 |
| JP | 11-094802 | | 4/1999 |
| JP | 1194802 | A * | 4/1999 |
| JP | 11-273615 | | 10/1999 |
| JP | 2001-93461 | | 4/2001 |
| JP | 200193461 | A * | 4/2001 |
| JP | 2002-015697 | | 1/2002 |
| JP | 2002-15698 | | 1/2002 |
| JP | 200215698 | A * | 1/2002 |
| JP | 2002-517887 | | 6/2002 |
| JP | 2004-028763 | | 1/2004 |

OTHER PUBLICATIONS

Suzuki, Shigeru et al., "A New Ionization Method for the LC/MS of Wastes and Related Compounds", Japan Society for Environmental Chemistry, pp. 764 to 765, 2003. (with English translation).

* cited by examiner

SPRAY GLOW DISCHARGE IONIZATION METHOD AND SYSTEM

TECHNICAL FIELD

The present invention relates to an in-spray glow discharge ionization method and apparatus used, for example, for mass spectrometry of a chemical compound having an unshared electron pair, π electrons, and the like.

BACKGROUND ART

In the mass spectrometry as described above, a method in which a compound constituting a sample to be measured is analyzed by ionization is called an ionization method.

Various ionization methods of a compound have been proposed, such as an Electron Ionization (EI) method, a Chemical Ionization (CI) method, a Fast Atom Bombardment (FAB) method, an Inductively Coupled Plasma (ICP) method, a Laser Desorption (LD) method, Thermospray method, an Electrospray Ionization (ESI) method, and an Atmospheric Pressure Chemical Ionization (APCI) method.

In mass spectrometry, a hybrid type analytical method has been widely performed in which a detection means is used in combination with another isolation means for a substance to be measured. In all the above techniques, it is naturally understood that effective ionization of a sample to be measured is very significant from a technical point of view to improve the accuracy and sensitivity of the analysis. In particular, in the hybrid type analytical method described above, a mass spectrometer is often provided in combination with an isolation means for a sample to be measured, such as gas chromatography (GC), liquid chromatography (LC), and capillary electrophoresis (CE).

In this hybrid type analytical method, it is important that an ionization means be provided which can efficiently ionize individual chemical components while decomposition of a compound to be measured, which is contained in a sample to be measured and which is isolated by the above isolation means, is suppressed as small as possible.

In the case in which a mass spectrometer is used in combination with an isolation apparatus other than gas chromatograph (GC), such as liquid chromatograph (LC) or capillary electrophoresis (CE), the electrospray ionization (ESI) method and the atmospheric pressure chemical ionization (APCI) method may be mentioned as efficient ionization methods. In the electrospray ionization method, when a compound to be measured, which is to be ionized, is a polar substance, the compound has a relatively low ionization potential or a high proton affinity or electron affinity, and thus the ionization is easily performed; however, when the compound is a non-polar substance, the ionization is not easily performed in many cases. In the atmospheric pressure chemical ionization method, an evaporated solvent is ionized by corona discharge and enables a substance to be easily ionized, and hence some non-polar substance can also be ionized; however, the above substance is required to have a higher proton affinity or electron affinity than that of the solvent or a lower ionization energy (also called an ionization potential) or acidity than that of the solvent. In order to improve the above problem in that non-polar substances are not easily ionized, an ionization method has been proposed in which an element with high ionization energy such as helium or argon is used together with a non-polar substance.

As a technique for improving mass spectrometric properties by the method described above, for example, a technique disclosed in the following patent document 1 may be mentioned.

The patent document 1 describes that, for example, non-polar molecules such as dioxins and PCB, which are minor constituents, are not easily ionized by an electrospray ionization method which is a conventional technique, and thus these molecules have been hardly detected.

Then, in the patent document 1, basically as a means for increasing efficiency of the ionization, the use of high frequency plasma generated by a microwave resonator is proposed. In addition, it is also proposed that a port for supplying a helium or argon gas is provided for a spray device for spraying liquids used in this technique, together with a sheath liquid supply port provided around a port for supplying an isolated sample to be measured for facilitating evaporation of the sample to be measured, so as to increase the ionization efficiency of components of the sample to be measured by the supply of the gas (see [0009] of the patent document 1).

Subsequently, it is described that by supplying the gas, plasma thereof is generated, and ionization of a non-polar compound can be improved which cannot be ionized by a conventional method due to its high ionization potential (see [0015] of the patent document 1). According to this document, since a helium gas and an argon gas are not used in an excited state but are in the form of plasma, it is estimated that the ionization is not caused by Penning effect.

Incidentally, Penning ionization is a phenomenon in which a metastable excited atom takes an electron out of a second atom with an ionization potential, whose energy is lower than that of the metastable atom. The electron is placed into a vacant ground state of the metastable atom, and the second atom is ionized.

In addition, a method has been reported in which an excited gas generated beforehand is allowed to act on a sprayed sample so as to increase ionization efficiency of the sample. The method which uses the principle of the Penning effect facilitates ionization of a sample to be measured which is isolated by another isolation means, and the sample thus ionized is supplied to a mass spectrometer. For example, a method developed by Zhu may be mentioned (disclosed in the patent document 2) in which a long cylindrical discharge chamber provided with a coil is used. Further to that, according to a method developed by Bertrand et al. (disclosed in the patent document 3), an interface to be connected to a mass spectrometer is provided. The interface, for example, is two chambers which include a gas mixing chamber and a discharge chamber. Hence, it is difficult to use with an apparatus of an atmospheric pressure chemical ionization (APCI) method using corona discharge electrodes, an electrospray ionization (ESI) method, or the like, which is one of the most widely used ionization methods of mass spectrometry.

[Patent Document 1] Japanese Unexamined Patent Application Publication No. 2001-108656

[Patent Document 2] U.S. Pat. No. 5,192,865

[Patent Document 3] U.S. Pat. No. 6,124,675

DISCLOSURE OF INVENTION

In consideration of the situations described above, an object of the present invention is to provide an in-spray glow discharge ionization method and an apparatus thereof which can be used together or alternately with the most widely used ionization method of mass spectrometry, such as an atmospheric pressure chemical ionization (APCI) method or an electrospray ionization (ESI) method, while enhancing ionization efficiency using a gas exhibiting Penning effect.

In order to achieve the above object, the present invention provides the following.

[1] An in-spray glow discharge ionization method which comprises supplying a gas exhibiting Penning effect so as to surround a fluid containing a compound to be measured for forming an nebulized flow of the fluid and generating glow discharge in the nebulized flow to generate cations of the gas exhibiting Penning effect and excited atoms exhibiting Penning effect so as to ionize a chemical substance having low ionization probability with high sensitivity, directly or indirectly through an intermediately generated chemical species.

[2] In the in-spray glow discharge ionization method in the above [1], the nebulized flow is heated.

[3] In the in-spray glow discharge ionization method in the above [1], a rare gas is used as the gas exhibiting Penning effect.

[4] In the in-spray glow discharge ionization method in the above [3], argon is used as the rare gas.

[5] In the in-spray glow discharge ionization method in the above [4], the rare gas is argon (Ar), and argon cations ($Ar^+$) and excited argon ($Ar^*$) are generated.

[6] The in-spray glow discharge ionization method in the above [1] further comprises blowing a dry gas in order to dry the nebulized flow.

[7] In the in-spray glow discharge ionization method in the above [6], a nitrogen gas, air, or a rare gas is used as the dry gas.

[8] An in-spray glow discharge ionization apparatus which comprises a supply port supplying a fluid containing a compound to be measured, a gas blowing port which surrounds the supply port and which blows a gas exhibiting Penning effect to nebulize the fluid supplied from the supply port, a ground-side discharge electrode provided at a generation port at which the nebulized flow is generated, and a voltage application-side discharge electrode which is disposed in the traveling direction of the nebulized flow and opposed to the ground-side discharge electrode. In the in-spray glow discharge ionization apparatus described above, measurement is performed using a mass spectrometer by ionizing components of the compound to be measured which constitutes the fluid by using a cationized and excited gas exhibiting Penning effect while the fluid is being nebulized by the gas exhibiting Penning effect.

[9] In the in-spray glow discharge ionization apparatus of the above [8], a dry gas blowing port for drying the nebulized flow is provided around or in the vicinity of the supply port and the gas blowing port for blowing a gas exhibiting Penning effect for nebulizing the fluid.

[10] In the in-spray glow discharge ionization apparatus of the above [8], the gas exhibiting Penning effect is a rare gas.

[11] In the in-spray glow discharge ionization apparatus of the above [10], the rare gas is He, Ne, Ar, Kr or Xe.

[12] In the in-spray glow discharge ionization apparatus of the above [8], the compound to be measured is a chemical substance which has low ionization probability.

[13] In the in-spray glow discharge ionization apparatus of the above [12], the chemical substance is an aromatic nitro compound, oxine copper, halogenated nitrobenzyl, or a polycyclic aromatic hydrocarbon.

[14] In the in-spray glow discharge ionization apparatus of the above [9], the dry gas is nitrogen, air, or a rare gas.

[15] In the in-spray glow discharge ionization apparatus of the above [8], a surface of at least one of the discharge electrodes is covered with a substance which has low oxidation state.

[16] In the in-spray glow discharge ionization apparatus of the above [15], the substance which has low oxidation state is gold, platinum, or silver.

[17] In the in-spray glow discharge ionization apparatus of the above [8], the voltage application-side discharge electrode includes a plurality of electrodes.

[18] In the in-spray glow discharge ionization apparatus of the above [17], each of said plurality of electrodes is a needle-shaped electrode.

[19] In the in-spray glow discharge ionization apparatus of the above [17] or [18], a tertiary actuator is provided for adjusting three-dimensional positions of the electrodes.

[20] In the in-spray glow discharge ionization apparatus of the above [8], electrical insulation is performed in an ion source except for the front end of the electrodes.

BEST MODE FOR CARRYING OUT THE INVENTION

Figure 1:
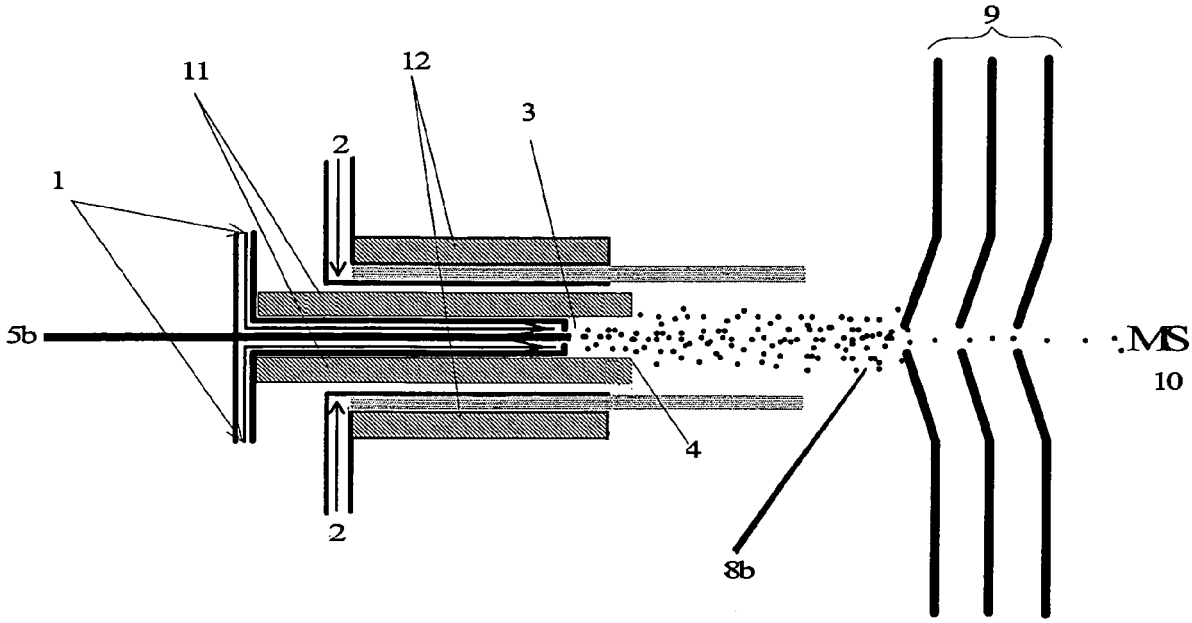
FIG. 1 is a schematic view of a conventional APCI apparatus.

A sheath gas supply means is provided to surround a gas supply means for supplying a gas exhibiting Penning effect which forms a nebulized flow or is provided in the vicinity of the above gas supply means. With the arrangement, the gas exhibiting Penning effect and a fluid containing a compound to be measured which is to be supplied to a mass spectrometer are sufficiently mixed together to form the nebulized flow, and the nebulized flow is supplied to discharge electrodes as a thin flow to generate discharge having a long and thin shape under a high current condition. As for the discharge electrodes, an electrode at the upstream side is a ground electrode, and an electrode at the downstream side is a voltage application electrode.

By the structure described above, while the fluid containing the compound to be measured is nebulized, the compound to be measured constituting the fluid can be ionized and supplied to the mass spectrometer.

Accordingly, analysis of the compound to be measured can be realized, the sensitivity of which is increased by two digits or more.

In the present invention, a gas exhibiting Penning effect is used as a spray gas.

In order to facilitate the ionization of the gas exhibiting Penning effect, at least one additive such as chloroform may be added to the gas exhibiting Penning effect or a liquid to be nebulized as one modification. This is called an ionization matrix, and the function of a solvent is similar to this.

Furthermore, the nebulized flow thus formed is discharged (constant current discharge) so that a constant current of several microamperes to several tens of milliamperes flows between an electrode provided at the front end of a fluid supply member or in the vicinity thereof and a single electrode or a plurality of electrodes provided at the downstream side of the nebulized flow. When the plurality of electrodes are used, it is important that the front end is disposed at the same distance from the upstream side electrode so that all the electrodes efficiently work for ionization. In this case, one modification may also be made in which discharge is performed by applying a voltage of several tens of volts to several tens of kilovolts in order to optimize the ionization.

It has been impossible by an APCI method, which is a prior art, to realize a high discharge current as obtained by the ionization means of the present invention and to realize efficient ionization by generating a large amount of an excited gas used for Penning ionization by the high discharge current without decomposition of molecules of a compound to be measured and the like. According to the present invention, by generation of a large amount of an excited gas used for Penning ionization by the high discharge current and rapid mixing of the excited gas and an nebulized flow of a substance to be measured, efficient ionization of the compound to be measured can be performed with an improved S/N ratio, thereby highly sensitive measurement can be realized.

In order to realize more preferable ionization, the structure is preferably formed in which generated ions are guided to a mass spectrometer by a repeller provided at a further downstream side.

In the present invention, the nebulized fluid supplied from the front end of the fluid supply member is heated by a gas at a temperature in the range of room temperature to several hundreds of degrees; however, at least one of the spraying gas and the sheath gas may be used for ionization at a low temperature, such as 0 to −180° C., using a liquid gas. In other words, one modification may be made in consideration of the state temperature of the compound to be measured.

As for the sheath gas (curtain gas), it is important to allow a sheath gas having a small Penning effect to flow so that discharge is formed to have a long and thin shape and to be stabilized. As the sheath gas having the properties described above, for example, a gas which does not so much interfere with the ionization efficiency, such as a dry nitrogen gas or pure air, may be mentioned.

Furthermore, in the case in which Penning ionization is performed by discharge at a small current such as approximately several tens of microamperes or less, discharge having a long and thin shape can be realized by using a gas exhibiting Penning effect as the sheath gas, and hence ,for example, He, Ne, Ar, Kr, or Xe may be used as the sheath gas.

EMBODIMENT

Hereinafter, features of the present invention will be described in detail with reference to drawings.

In recent years, a liquid chromatography/mass spectrometry (LC/MS) for an environmental chemical substance has been rapidly developed, and a great number of analyses relating to environments and waste materials require the LC/MS. However, there are not a few chemical substances relating to environments, waste materials and the like, which show no or poor sensitivity in current LC/MS.

Hence, in order to measure, with high sensitivity, the chemical substances relating to environments, waste materials and the like, such as polycyclic aromatic hydrocarbons, oxine copper, halogenated hydrocarbons, and aromatic nitro compounds, which show poor sensitivity by ionization using APCI or ESI, a new ionization method, or in-Spray Glow Discharger Ionization (SGDI), was developed by the inventors of the present invention.

Figure 2:
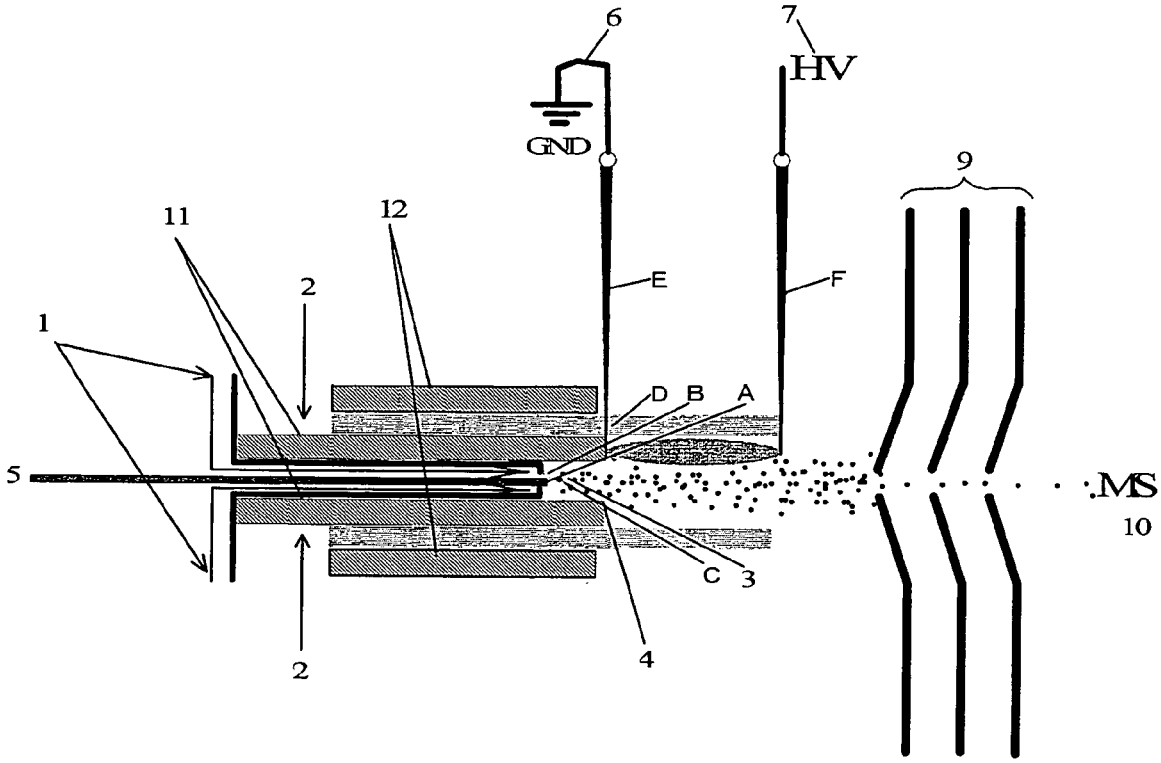
FIG. 2 is a schematic view of a basic structure of an in-spray glow discharge ionization (SGDI) apparatus according to the present invention.

FIG. 2 is a schematic view showing a basic structure of an in-spray glow discharge ionization (SGDI) apparatus according to the present invention.

In this figure, character A indicates a supply port for supplying a fluid containing a compound to be measured; character B indicates a gas blowing port which surrounds the supply port A and which blows a gas exhibiting Penning effect for nebulizing the fluid supplied from the supply port A; character C indicates a generation port for generating a nebulized flow; character D indicates a blowing port for blowing a dry gas (sheath gas) to dry the nebulized flow; character E indicates a discharge electrode at a ground side provided for the generation port C for the nebulized flow; and character F indicates a discharge electrode at a voltage application side which is disposed in the traveling direction of the nebulized flow and which is opposed to the discharge electrode E at the ground side. In this structure, while the fluid from the supply port A is nebulized by the gas exhibiting Penning effect, components of the compound to be measured which constitutes the fluid are ionized by the excited gas exhibiting Penning effect, so that the mass spectrometry is performed.

Further details of the structure are as follows. Reference numeral 1 indicates a spray gas exhibiting Penning effect, reference numeral 2 indicates the sheath gas, reference numeral 3 indicates a nebulized flow-forming nozzle, reference numeral 4 indicates a nebulized flow supply port, reference numeral 5 indicates a fluid inlet supplying the fluid containing the compound to be measured which is isolated by high performance liquid chromatography, reference numeral 6 indicates a discharge electrode device (at the ground side), reference numeral 7 indicates a discharge electrode device (voltage application electrode), reference numeral 9 indicates a differential pumping system (skimmer) for a mass spectrometer, reference numeral 10 indicates the mass spectrometer, reference numeral 11 indicates a cylindrical heater for heating the nebulized flow, and reference numeral 12 indicates an annular heater for heating the sheath gas.

In FIG. 2, for example, a fluid containing compound molecules to be measured which is isolated by high performance liquid chromatography, capillary electrophoresis or the like is supplied from the fluid inlet 5 under atmospheric pressure, and the spray gas 1 exhibiting Penning effect is introduced by the nebulized flow-forming nozzle 3 at the generation port C for the nebulized flow around the fluid supply port A, so that the fluid is nebulized. In this case, the spray gas 1 exhibiting Penning effect is supplied using a tube having an inside diameter (I.D.) of approximately 1 to 3 mm and formed of stainless steel (SUS) or a tetrafluoroethylene resin.

In addition, the fluid thus supplied is heated by the cylindrical heater 11 for heating the nebulized flow, in order to facilitate the evaporation of the fluid. Furthermore, since the sheath gas is supplied so as to surround the spray gas 1 exhibiting Penning effect, the diffusion of the nebulized flow is suppressed, and a nebulized flow sufficiently mixed with the gas exhibiting Penning effect is formed. In this case, the sheath gas 2 is supplied using a tube having an inside diameter (I.D.) of approximately 1 to 3 mm and formed of stainless steel (SUS) or a tetrafluoroethylene resin.

Furthermore, as for the discharge electrodes, the ground electrode 6 is disposed at the upstream side of the nebulized flow, and the voltage application electrode 7 is disposed at the downstream side thereof. By applying a voltage of several tens of volts to several tens of kilovolts between the electrodes 6 and 7 which expose the front ends thereof in the nebulized flow, the electrode 6 at the upstream side is electrically connected to the nebulized flow supply port 4 and is grounded. In addition, by glow discharge using the voltage application electrode 7 which is disposed to be electrically insulated from the environment, excited atoms and cations are generated, the compound molecules to be measured and the generated excited atoms and cations of the spray gas 1 exhibiting Penning effect are sufficiently mixed together, and the above compound molecules in the nebulized flow can be relatively stably and efficiently ionized. Generated ions of the compound to be measured are guided to the differential pumping system 9 for a mass spectrometer and to an inlet of the mass spectrometer (MS) 10 and then detected.

Figure 3:
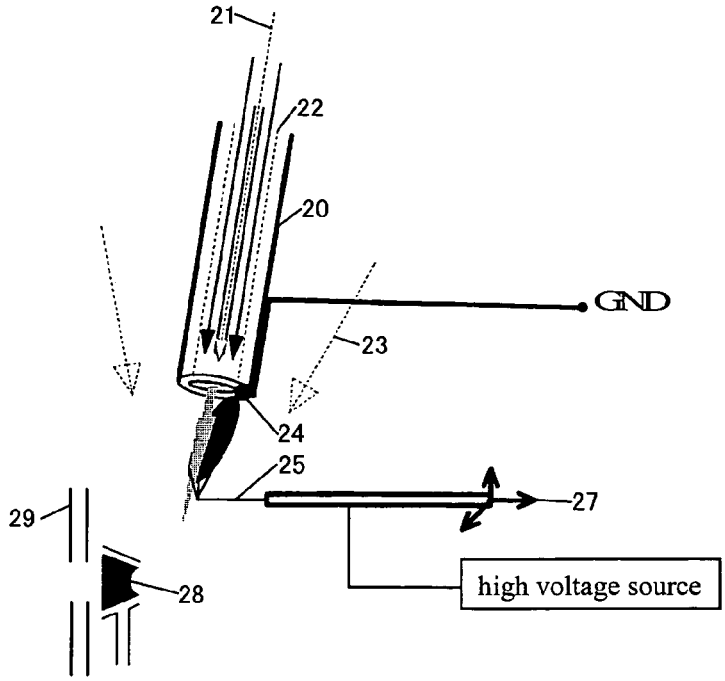
FIG. 3 is a schematic view of the structure of an SGDI ion source according to the present invention.
Figure 4:
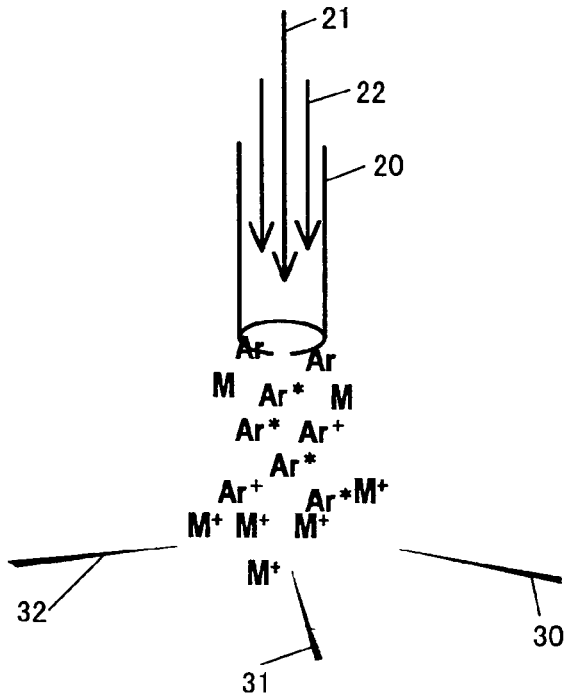
FIG. 4 is a schematic view of the structure of an important portion of an ion source according to the present invention.
Figure 5:
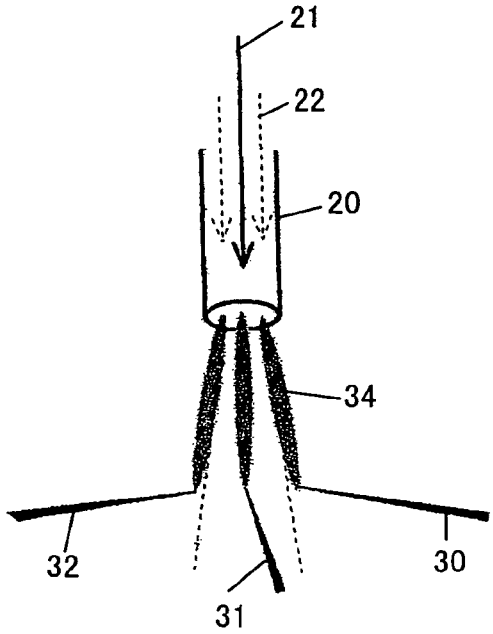
FIG. 5 is a view showing the principle of ionization according to the present invention.

FIG. 3 is a schematic view showing the structure of an SGDI ion source according to the present invention, FIG. 4 is a schematic view showing an important structural portion of the above SGDI ion source, and FIG. 5 is a schematic view showing the principle of ionization of the above SGDI ion source.

In FIG. 3, reference numeral 20 indicates a heater probe; reference numeral 21 indicates an eluate or a gas obtained from a chromatograph such as HPCL (High Performance Liquid Chromatography), CE (Capillary Electrophoresis), GC (Gas Chromatography), SFC (Supercritical Fluid Chromatograph), or the like, reference numeral 22 indicates a rare gas, such as He, Ne, Ar, Kr, or Xe, as a spray gas for nebulizing the eluate or the gas 21 from the chromatograph, and reference numeral 23 indicates a dry gas blown for drying the nebulized flow, in which a nitrogen gas or air is used when the glow discharge current is high, and a rare gas is used when the glow discharge current is low. Reference numeral 24 indicates a ground electrode (glow discharge electrode), reference numeral 25 indicates a voltage application electrode (glow discharge electrode), reference numeral 26 indicates a high voltage source, reference numeral 27 indicates a three-dimensional actuator, reference numeral 28 indicates a mass suction port, and reference numeral 29 indicates a mass spectrometer.

In addition, as the voltage application electrode, as shown in FIGS. 4 and 5, a plurality of needle-shaped electrodes 30, 31, and 32 may be disposed. In FIG. 5, reference numeral 34 indicates glow discharge.

Furthermore, in order to optimize a discharge state, the voltage application electrode can be adjusted in three directions x, y, and z by a three-dimensional actuator.

In addition, the surface of the discharge electrode is covered with a substance which has low oxidation state such as gold, platinum, or silver, preferably.

In addition, in this case, it is manufactured by adding the glow discharge electrodes 24 and 25 and the high voltage source 26 to the heater probe 20 of a commercially available LC/MS apparatus, and argon is used as the spray gas 22. Accordingly, it is easy to replace a conventional ionizing apparatus with that of the present invention, thus the apparatus of the present invention can be used together therewith in a mutually complementary manner, and the manufacturing cost is inexpensive.

The mechanism of ionization will be described with reference to FIGS. 4 and 5.

The eluate (gas may also be used) from the chromatograph is nebulized from the heater probe 20 by the spray gas (Argon) 22, and glow discharge occurs under the atmosphere, so that argon cations ($Ar^+$) and excited argon ($Ar^*$) are generated. These $Ar^+$ and $Ar^*$ directly ionize chemical substances which show poor sensitivity (high ionization energy and low proton affinity) by APCI and ESI, or indirectly ionize them via intermediate chemical species such as $H_3O^+$ having a high internal energy, so that high sensitivity can be obtained.

A more detailed ionization mechanism will be described below.

$$Ar+\Delta H \rightarrow Ar^* \quad (1)$$

$$Ar^*+M \rightarrow Ar^-+M^++e^- \quad (2)$$

In the equations, ΔH indicates an excitation energy of argon (Ar), $Ar^*$ indicates excited argon, and M indicates a molecule to be ionized. The above equation (2) is called Penning ionization. In addition, the following reactions are also carried out in parallel.

$$Ar+\Delta H' \rightarrow Ar^*+e \quad (3)$$

$$Ar^++M \rightarrow Ar+M^+ \quad (4)$$

$$Ar^++M \rightarrow ArM^+ \quad (4')$$

$$Ar^++mS \rightarrow Ar+S^+nS+(m-n-1)S^- \quad (5a)$$

$$Ar^*+mS \rightarrow Ar^-+S^+nS+(m-n-1)S^- \quad (5a')$$

$$Ar^++mS \rightarrow Ar+H^+nS+[S-H]\cdot(m-n-1)S \quad (5b)$$

$$Ar^*+mS \rightarrow Ar^-+H^+nS+[S-H]\cdot(m-n-1)S \quad (5b')$$

$$S^+nS+M \rightarrow (n+1)S+M^+ \quad (6a)$$

$$H^+nS+M \rightarrow nS+MH^+ \quad (6b)$$

In the equations, ΔH' indicates ionization energy of Ar, S indicates a solvent molecule, and $H^+$ indicates a proton. The equations (6a) and (6b) indicate the same ionization method as that of the atmospheric pressure chemical ionization (APCI) method.

Next, a mass spectrum of a brominated flame retardant and a mass chromatogram of an aromatic nitro compound and the like were compared with those of conventional ionization methods (APCI and ESI), and features and sensitivity of the new ionization method were evaluated.

Figure 6:
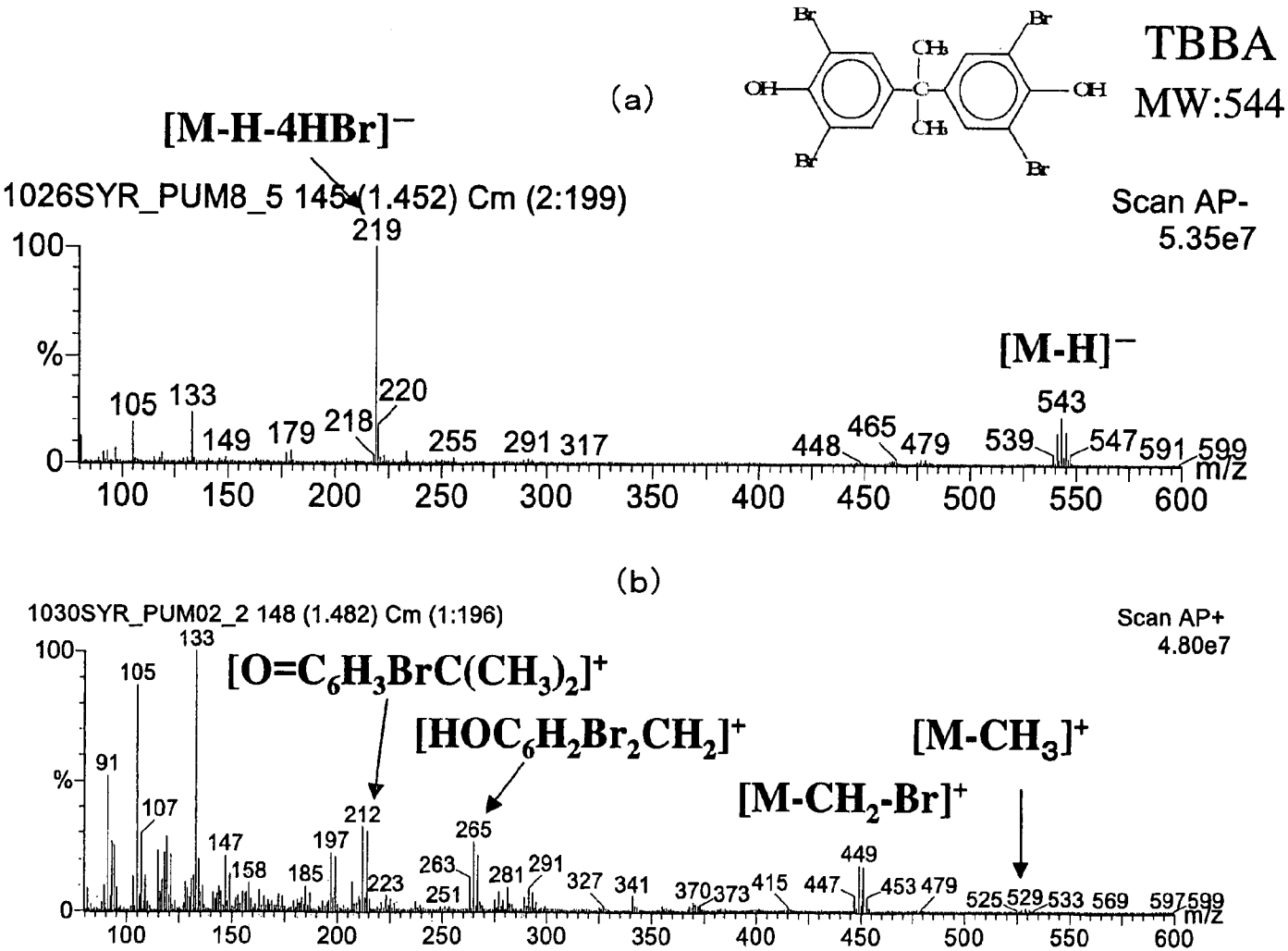
FIG. 6 includes views showing the comparison between a spectrum of TBBA obtained by an SGDI method according to the present invention and that obtained by a conventional APCI method.

FIG. 6 includes views showing the comparison between a TBBA spectrum obtained by the SGDI method of the present invention and that obtained by the conventional APCI method.

As shown in FIG. 6(*a*), the conventional APCI method is an ionization method caused by solvent ions, and ionization energy is low. Consequently, only deprotonated ions of the molecules and ions obtained by further elimination of 4HBr are observed.

On the other hand, as shown in FIG. 6(*b*), in the SGDI method of the present invention, reactions by cations and metastable substances such as $Ar^+$ and $Ar^*$ preferentially occur. Consequently, by excessive energy in ionization, the TBBA ions are cleaved, and a large number of fragment ions are generated.

Next, the sensitivity of the SGDI method of the present invention to a chemical substance which shows poor sensitivity in the conventional APCI method and ESI method will be described.

Figure 7:
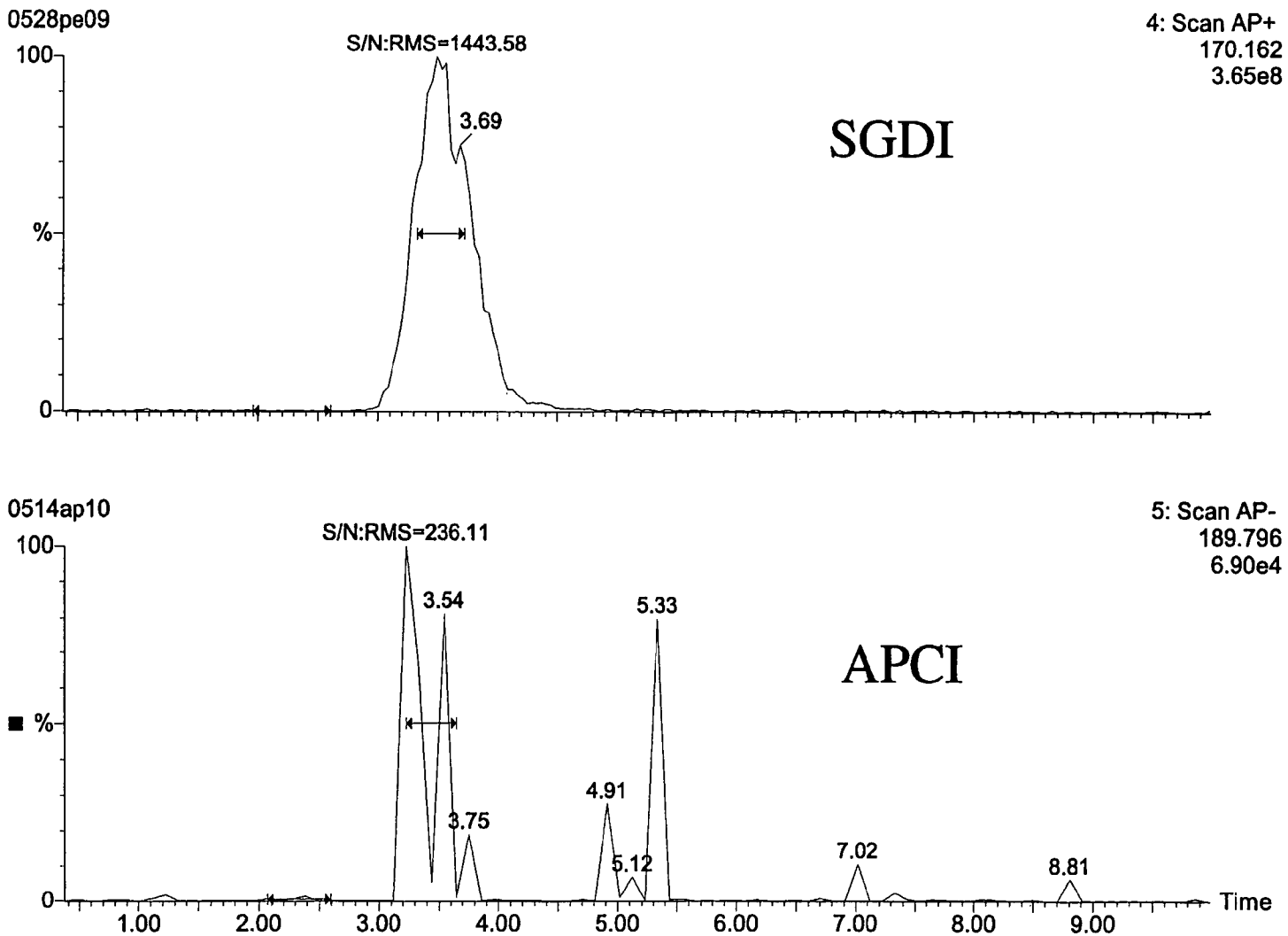
FIG. 7 includes views showing the comparison between a spectrum of nitrobiphenyl using a mass chromatogram obtained by an SGDI method according to the present invention and that obtained by a conventional APCI method.
Figure 8:
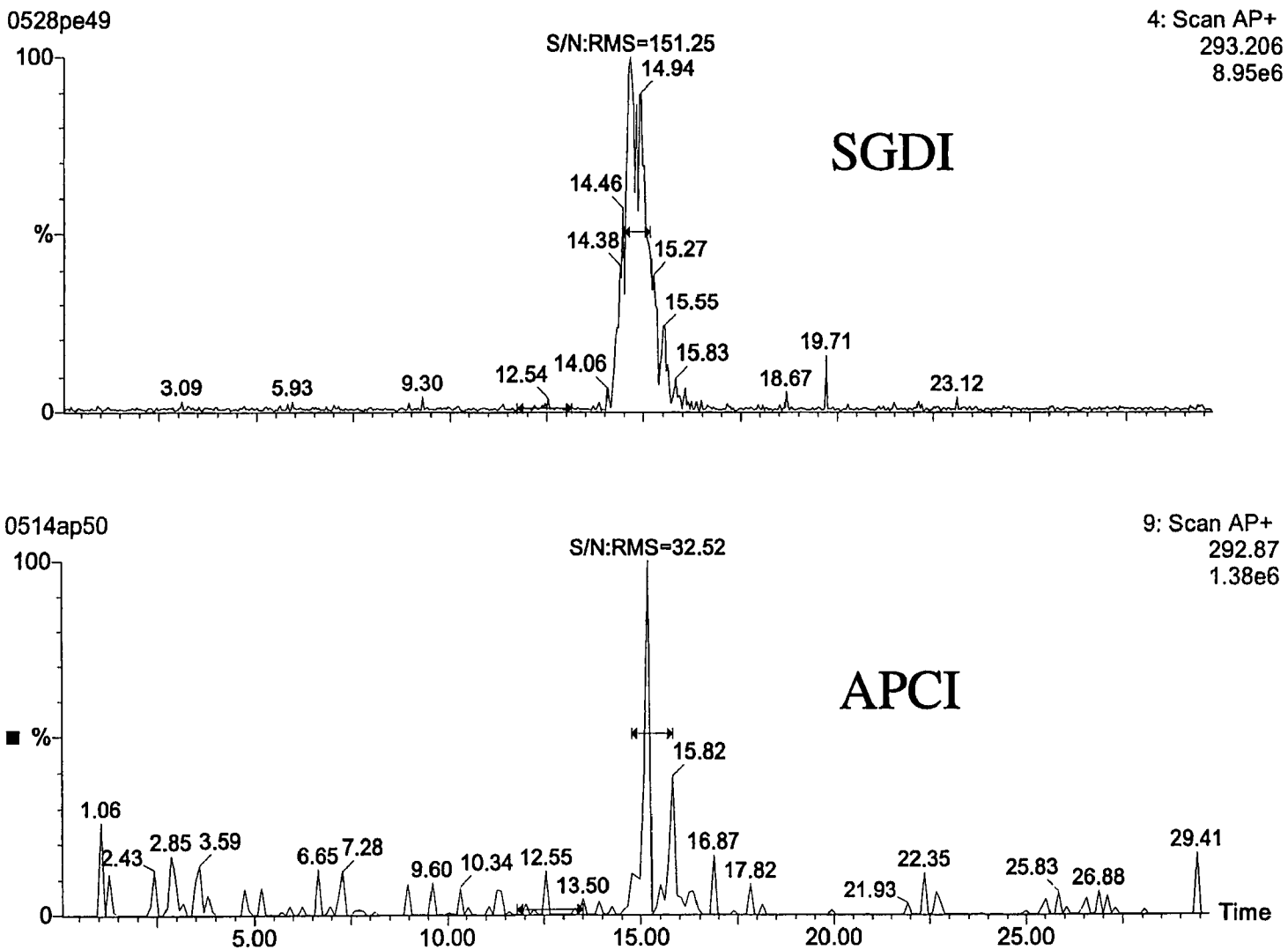
FIG. 8 includes views showing the comparison between sensitivity of TBA bisallyl ether using a mass chromatogram obtained by an SGDI method according to the present invention and that obtained by a conventional APCI method.
Figure 9:
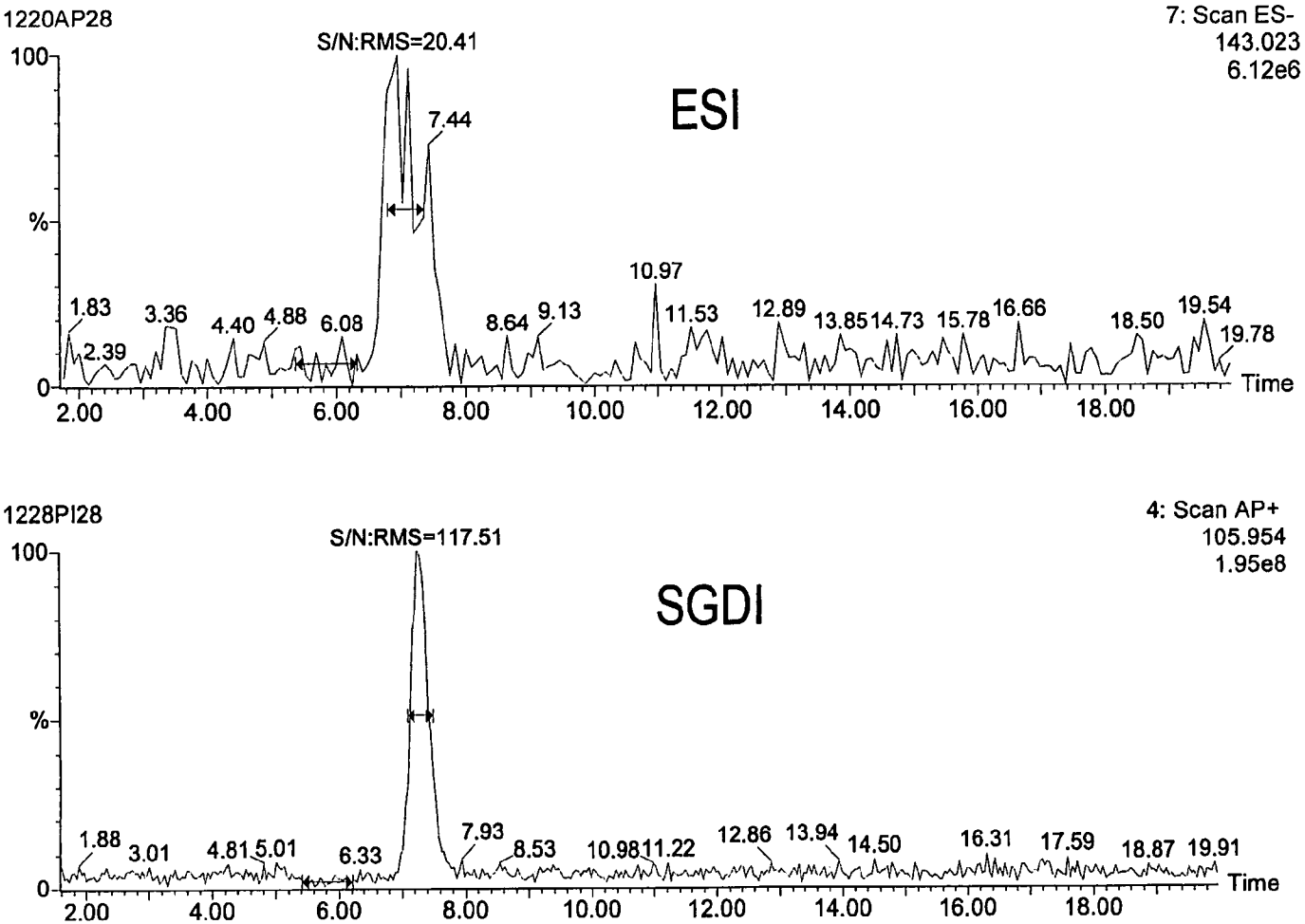
FIG. 9 includes views showing the comparison between sensitivity of 4-nitrobenzyl bromide using a mass chromatogram obtained by an SGDI method according to the present invention and that obtained by a conventional ESI method.
Figure 10:
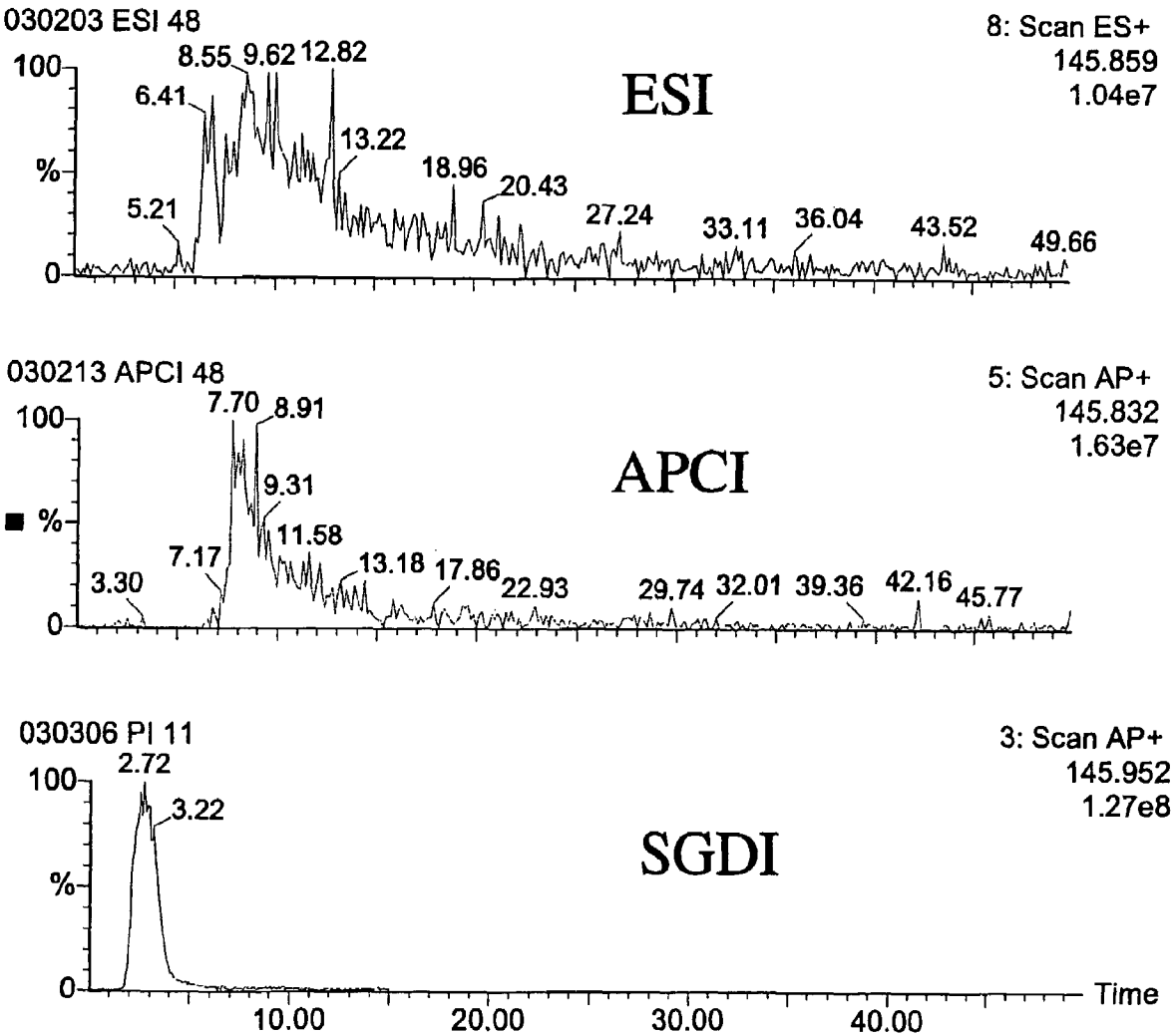
FIG. 10 includes views showing the comparison between sensitivity of oxine copper using chromatograph obtained by an SGDI method according to the present invention and those obtained by a conventional ESI method and APCI method.

The comparisons between sensitivity of a mass chromatogram obtained by the SGDI method of the present invention and that obtained by the conventional APCI method are shown in FIG. 7 (nitrobiphenyl) and FIG. 8 (TBA bisallyl ether), the comparison between sensitivity of 4-nitrobenzyl bromide in the SGDI method of the present invention and that in the conventional ESI method (in the APCI method, no sensitivity is shown due to decomposition) is shown in FIG. 9, and the comparison between sensitivity of oxine copper in the SGDI method of the present invention and in the conventional APCI method and ESI method is shown in FIG. 10.

As can be seen from these figures, by the conventional APCI method in which ionization is performed through a solvent and ESI method in which ion generation is principally performed by ion evaporation in a high electric field, substances having a low proton affinity and a high ionization energy are not easily ionized.

On the other hand, according to the SGDI method of the present invention, in addition to ionization through a solvent, Penning ionization by excited argon ($Ar^*$) and ionization by argon cations ($Ar^+$) are carried out in parallel. In the SGDI method, since a large amount of the metastable substances ($Ar^*$) having a high energy are generated, and an object substance can be ionized directly or indirectly through intermediately generated chemical species having a high internal energy, such as $H_3O^+$, high sensitivity can be obtained.

Table 1 shows the SGDI sensitivity (relative to that of a conventional method) to chemical substances having a high ionization energy and a low proton affinity.

TABLE 1

| name | CAS. NO. | Chemical formula | MW | * |
|---|---|---|---|---|
| acrylamide | 79-06-1 | $C_3H_5NO$ | 71.1 | 18 |
| diethylenetriamine | 111-40-0 | $C_4H_{13}N_3$ | 103.2 | 5 |
| dimethyl terephthalate | 120-61-6 | $C_{10}H_{10}O_4$ | 194.3 | 20 |
| 1,3-dinitrobenzene | 99-65-0 | $C_6H_4N_2O_4$ | 168.1 | 18 |
| 2-ethylhexylmethacrylate | 688-84-6 | $C_{12}H_{22}O_2$ | 198.3 | 4 |
| Ethylthiometon | 298-04-4 | $C_8H_{19}O_2PS_3$ | 274.4 | 4 |
| Oxyne copper | 10380-28-6 | $C_{18}H_{12}CuN_2O_2$ | 35109 | 11 |
| terephthalic acid | 100-21-0 | $C_8H_6O_4$ | 166.1 | 33 |
| acenaphthene | 83-32-9 | $C_{12}H_{10}$ | 154.2 | 10 |
| 2,4-dinitrotoluene | 121-14-2 | $(NO_2)_2C_6H_3CH_3$ | 182.1 | 11 |
| 4-nitroindane | 34701-14-9 | $C_9H_9NO_2$ | 163.2 | 598 |
| 4-nitrobenzylbromide | 100-11-8 | $NO_2C_6H_4CH_2Br$ | 216.0 | 227 |
| 4-nitrobenzylchloride | 100-14-1 | $O_2NC_6H_4CH_2Cl$ | 171.6 | 329 |
| 2-nitrobenzyl | 86-00-0 | $C_6H_5C_6H_4NO_2$ | 199.2 | 4 |
| 2-nitrofluorene | 607-57-8 | $C_{13}H_9NO_2$ | 211.2 | 128 |
| 1-nitronaphthalene | 86-57-7 | $C_{10}H_7NO_2$ | 173.2 | 162 |
| 4-nitrophenol | 100-02-7 | $O_2NC_6H_4OH$ | 139.1 | 2 |
| phenanthrene | 85-01-8 | $C_{14}H_{10}$ | 178.2 | 4 |
| pyrene | 129-00-0 | $C_{16}H_{10}$ | 202.3 | 8 |
| tetrabromo-BPA | 79-94-7 | $C_{15}H_{12}Br_4O_2$ | 543.9 | 0.3 |
| TBA-bis-allylether | 25327-89-3 | $C_{21}H_{20}Br_4O_2$ | 624.0 | 15 |

*: sensitivity(SGDI/conventional)

As apparent from these figures and the table, a substance which can be ionized by an ionization method (ESI method or APCI method) of conventional LC/MS, which is a dominant analytical method for low volatile chemical substances in environments and waste materials, is a substance (1) having proton affinity to a certain extent, a substance (2) having electron affinity to a certain extent, a substance (3) having low ionization energy, or a substance (4) having a high acidity; however, by the development of the SGDI method according to the present invention, a substance having π electron can be analyzed with high sensitivity, (5) regardless of the degree of proton affinity and (6) regardless of the degree of ionization energy.

SPECIFIC EXAMPLE 1

In this example, as a sample to be measured, 10 μL of a standard solution containing 1-nitronaphthalene at a concentration of 100 ppm was injected in a high performance liquid chromatograph (HPLC) (Alliance 2690 manufactured by Waters Corp.) using a C18 (Waters Xterra-C18; chemical composition: octadecylsilane) column as a stationary phase, and water/acetonitrile at a ratio of 20/80 was used as a mobile phase, so that isolation was performed. Next, the mobile phase flowing out of the column was supplied to the apparatus of the present invention shown in FIG. 2, which was configured to ionize compound components to be measured and then to supply them to a mass spectrometer (MS: ZQ-4000 manufactured by Waters Corp.), and to the conventional APCI apparatus (provided for ZQ-4000 manufactured by Waters Corp.) shown in FIG. 1, followed by ionization in each apparatus. Subsequently, the ionized substances in the each apparatus were measured under the same mass scanning condition in which mass spectrum was repeatedly and continuously measured. When the intensity of a specific mass characteristic to the substance to be measured is plotted to the time axis, a chromatogram showing the change in quantity of the substance with time can be obtained. The height of the peak or the area thereof is proportional to the quantity of the sample ionized. The sensitivity of ionization means the peak height, the area thereof or the S/N (signal/noise) ratio.

Figure 11:
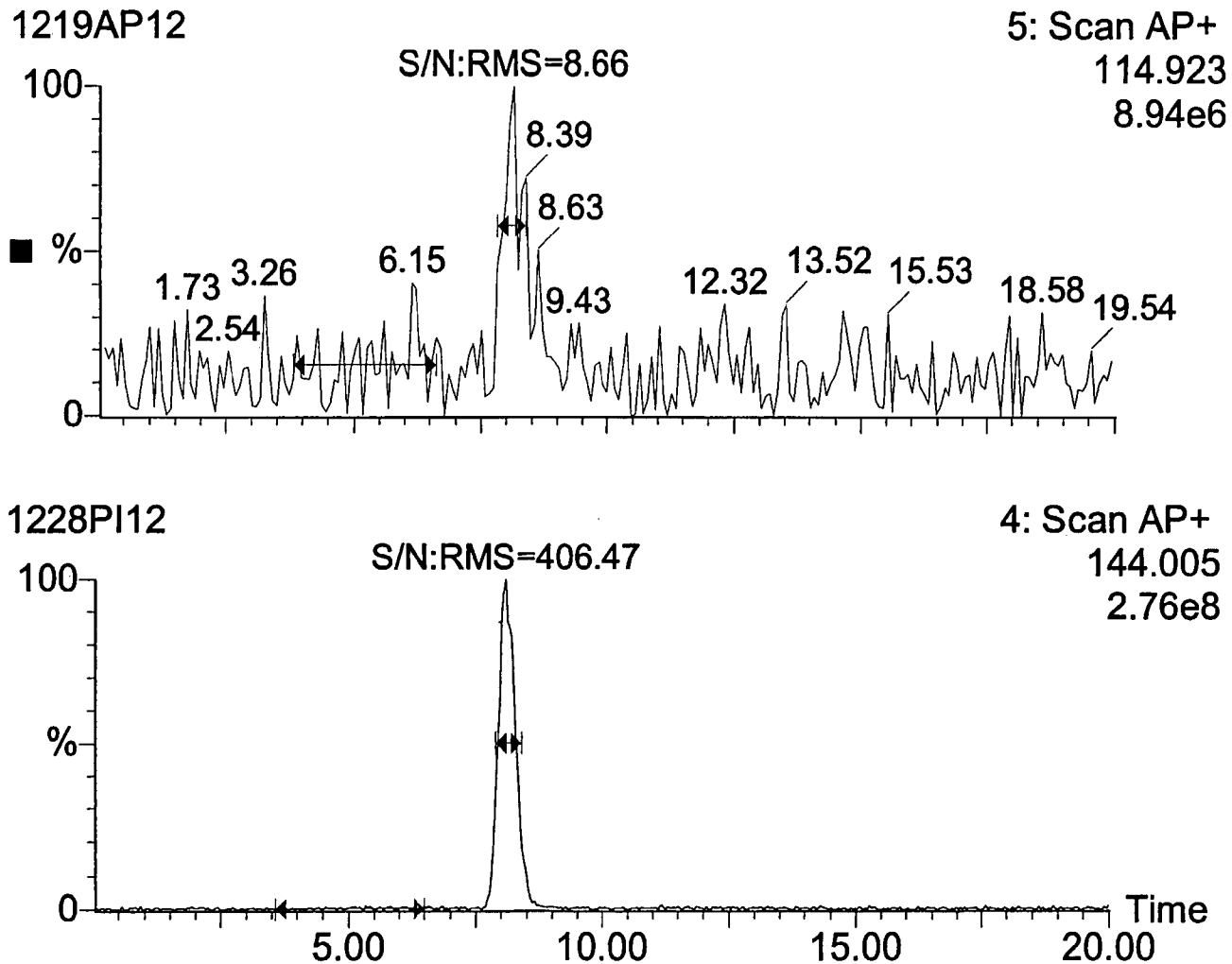
FIG. 11 includes views showing the comparison between analytical sensitivity of 1-nitronaphthalene contained in a sample to be measured obtained in Specific Example 1 and that obtained by the APCI apparatus shown in FIG. 1.

The chromatograms thus obtained are shown in FIG. 11. The chromatogram in the top column was obtained in combination with the APCI apparatus under the conditions in which an ionization current was 4 μA, nitrogen was used as the sheath gas, the temperature and the flow rate thereof were 450° C. and 513 liters per hour, respectively, nitrogen was also used as the spray gas, and the flow rate thereof was 6 liters per hour. The chromatogram in the bottom column was obtained in combination with the apparatus of the present invention under the conditions in which an ionization current was 30 μA, argon was used as the sheath gas, the temperature and the flow rate thereof were 450° C. and 513 liters per hour, respectively, argon was also used as the spray gas, and the flow rate thereof was 6 liters per hour. It is understood that when the S/N ratios of these peaks were compared with each other, the sensitivity obtained in combination with the apparatus of the present invention is improved by approximately 50 times.

In the conventional APCI apparatus shown in FIG. 1, reference numeral 5*b* indicates a spray gas supply means in the form of a tube having an inside diameter (I.D.) of approximately 1 to 3 mm and formed of stainless steel (SUS) or a polytetrafluoroethylene resin, and reference numeral 8*b* indicates corona discharge electrodes ionizing nebulized compound molecules to be measured. The differences of the conventional APCI apparatus from the apparatus of the present invention are the combination of the spraying gas exhibiting Penning effect and the sheath gas and the arrangement and structure of the discharge electrodes.

In FIG. 11, in the top column, 1219AP12 indicates the data number, S/N:RMS=8.66 indicates the S/N ratio, 5:ScanAP$^+$ indicates mass detection conditions, 114.923 indicates the mass of a measured ion, and 8.94e6 means $8.94\times10^6$ and indicates a full scale value of detection signal intensity. In the bottom column, 1228PI12 indicates the data number, S/N: RMS=406.47 indicates the S/N ratio, 4:ScanAP$^+$ indicates mass detection conditions, 144.005 indicates the mass of a measured ion, and 2.76e8 means $2.76\times10^8$ and indicates a full scale value of detection signal intensity. In FIG. 11, the mass number of the measured ion in the top column and that in the bottom column are different from each other. The reasons for this are that ions generated from the same substance are generally different when different ionization methods are used, and that in Specific Example 1, such ions were used that obtain the most preferable S/N ratios by the individual ionization methods.

SPECIFIC EXAMPLE 2

As a sample to be measured, 10 μL of a standard solution containing 2-nitrofluorene at a concentration of 100 ppm was injected in a high performance liquid chromatograph (HPLC) (Alliance 2690 manufactured by Waters Corp.) using a C30 (Develosil RPFULLERENE manufactured by Nomura Chemical Co., Ltd.; chemical composition: triacontylsilane) column as a stationary phase, and water/methanol at a ratio of 10/90 was used as a mobile phase, so that isolation was performed. Next, the mobile phase flowing out of the column B was supplied to the apparatus of the present invention shown in FIG. 2, which was configured to ionize compound components to be measured and then to supply them to a mass spectrometer (MS: ZQ-4000 manufactured by Waters Corp.), and to the conventional APCI apparatus (provided for Quattro Ultima manufactured by Micromass Inc.) shown in FIG. 1, followed by ionization in each apparatus. Next, the ionized substances in each apparatus were measured under the same mass scanning condition.

Figure 12:
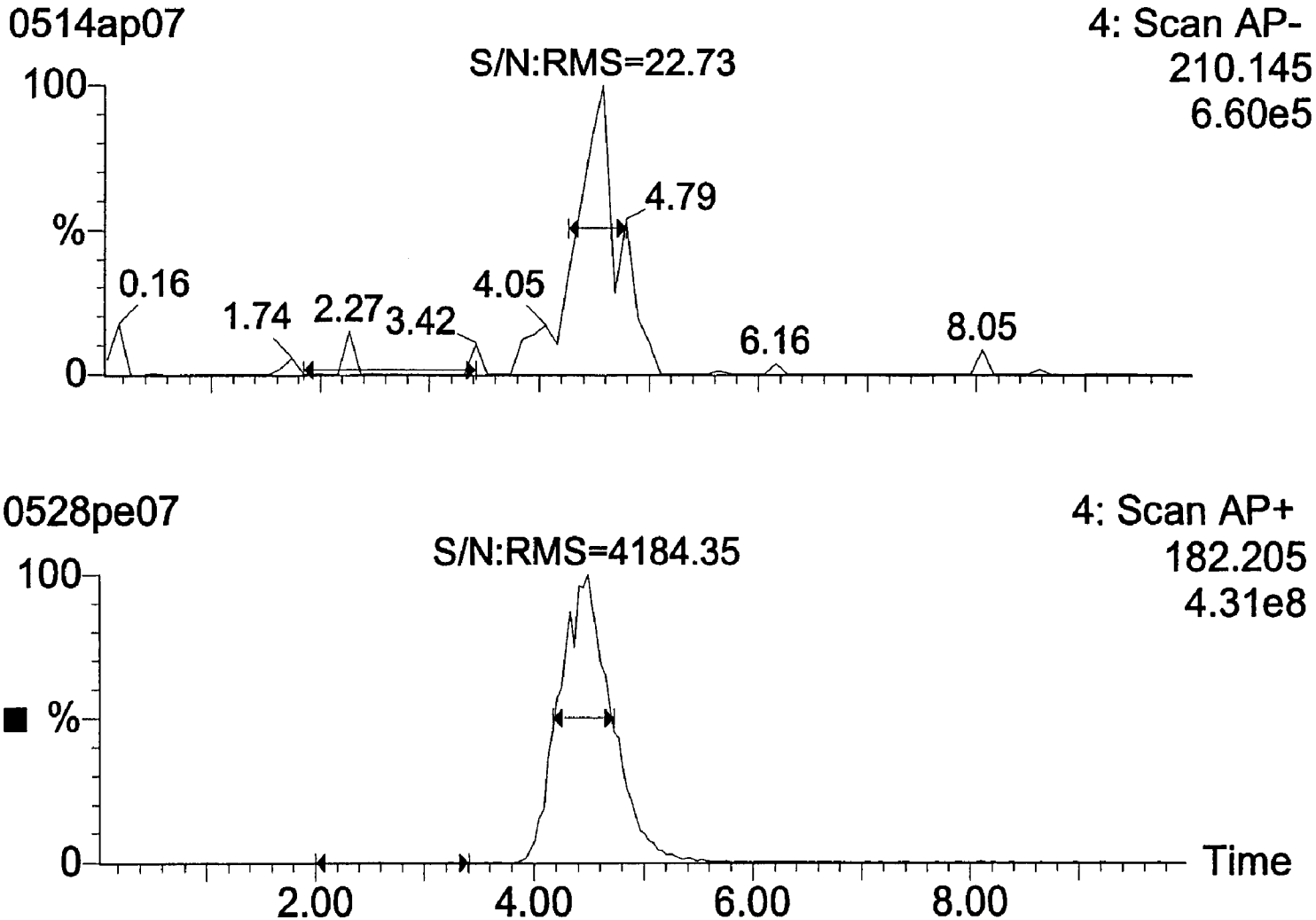
FIG. 12 includes views showing the comparison between analytical sensitivity of 2-nitrofluorene contained in a sample to be measured obtained in Specific Example 2 and that obtained by the APCI apparatus shown in FIG. 1.

The chromatograms thus obtained are shown in FIG. 12. The chromatogram in the top column was obtained in combination with the APCI apparatus under the conditions in which an ionization current was 2.5 μA, nitrogen was used as the sheath gas, the temperature and the flow rate thereof were 480° C. and 499 liters per hour, respectively, nitrogen was also used as the spray gas, and the flow rate thereof was 5.6 liters per hour. The chromatogram in the bottom column was obtained in combination with the apparatus of the present invention under the conditions in which an ionization current was 700 μA, nitrogen was used as the sheath gas, the temperature and the flow rate thereof were 480° C. and 482 liters per hour, respectively, argon was used as the spray gas, and the flow rate thereof was 5.6 liters per hour. It is understood that when the S/N ratios of these peaks were compared with each other, the sensitivity obtained in combination with the apparatus of the present invention is improved by approximately 200 times.

In FIG. 12, in the top column, 0514ap07 indicates the data number, S/N:RMS=22.73 indicates the S/N ratio, 4:ScanAP$^-$ indicates mass detection conditions, 210.145 indicates the mass of a measured ion, and 6.60e5 means $6.60\times10^5$ and indicates a full scale value of detection signal intensity. In the bottom column, 0528pe07 indicates the data number, S/N: RMS=4184.35 indicates the S/N ratio, 4:ScanAP$^+$ indicates mass detection conditions, 182.205 indicates the mass of a measured ion, and 4.31e8 means $4.31\times10^8$ and indicates a full scale value of detection signal intensity. In addition, in FIG. 12, the mass number of the measured ion in the top column and that in the bottom column are different from each other. The reasons for this are that ions generated from the same substance are generally different when different ionization methods are used, and that in Specific Example 2, such ions were used that obtain the most preferable S/N ratio by the individual ionization methods.

The above compounds to be measured are harmful environmental pollutants which exhibit the estrogenic effect and antiandrogenic effect as the metabolic, and a trace quantity thereof is required to be detected.

Unlike a conventional case in which a reaction chamber is provided and in which compound components to be measured are ionized and are then supplied to a mass spectrometer (MS), a nebulized flow is directly glow discharged, and ionization is performed using generated cations and excited atoms of a gas exhibiting Penning effect in the spray glow discharge ionization method and apparatus of the present invention. Hence, the in-spray glow discharge ionization and apparatus of the present invention can enhance the ionization efficiency, and may be used together or alternately with the atmospheric pressure chemical ionization (APCI) method or the electrospray ionization (ESI) method, which is one of the most widely used ionization method of mass spectrometry.

INDUSTRIAL APPLICABILITY

The in-spray glow discharge ionization method and apparatus of the present invention is particularly preferably used for mass spectrometry of chemical substances relating to environments and waste materials. In addition, there are a great number of chemicals to which the present invention is effectively applied in drugs relating to metabolism.

The invention claimed is:

1. An in-spray glow discharge ionization method comprising the steps of:

(a) supplying a fluid containing a substance to be measured and a gas exhibiting Penning effect which is used for forming an a nebulized flow of the fluid; and (b) generating glow discharge in the nebulized flow of the gas exhibiting Penning effect and the fluid nebulized thereby by applying a voltage of several tens of volts to several tens of kilovolts to generate cations of the gas exhibiting Penning effect and excited atoms exhibiting Penning effect so as to ionize a chemical substance having low ionization probability with high sensitivity, directly or indirectly through an intermediately generated chemical species, wherein the chemical substance is an aromatic nitro compound, oxine copper, halogenated nitrobenzyl, or a polycyclic aromatic hydrocarbon.

2. The in-spray glow discharge ionization method according to claim 1, wherein the nebulized flow is heated.

3. The in-spray glow discharge ionization method according to claim 1, wherein a rare gas is used as the gas exhibiting Penning effect.

4. The in-spray glow discharge ionization method according to claim 3, wherein argon is used as the rare gas.

5. The in-spray glow discharge ionization method according to claim 4, wherein the rare gas is argon (Ar), and argon cations ($Ar^+$) and excited argon ($Ar^*$) are generated.

6. The in-spray glow discharge ionization method according to claim 1, further comprising blowing a dry gas in order to dry the nebulized flow.

7. The in-spray glow discharge ionization method according to claim 6, wherein a nitrogen gas, air, or a rare gas is used as the dry gas.

8. An in-spray glow discharge ionization apparatus comprising:

(a) a supply port supplying a fluid containing a substance to be measured;

(b) a gas blowing port which blows a gas exhibiting Penning effect to nebulize the fluid supplied from the supply port;

(c) a ground-side discharge electrode provided at a generation port at which the nebulized flow is generated; and (d) a voltage application-side discharge electrode which is disposed in the traveling direction of the nebulized flow and opposed to the ground-side discharge electrode, and which is applied with a voltage of several tens of volts to several tens of kilovolts;

wherein mass spectrometry is performed by ionizing components of the substance to be measured which constitutes the fluid using a cationized and excited gas exhibiting Penning effect while the fluid is being nebulized by the gas exhibiting Penning effect.

9. The in-spray glow discharge ionization apparatus according to claim 8, further comprising a dry gas blowing port for drying the nebulized flow provided around or in the vicinity of the supply port and the gas blowing port for blowing a gas exhibiting Penning effect for nebulizing the fluid.

10. The in-spray glow discharge ionization apparatus according to claim 8, wherein the gas exhibiting Penning effect is a rare gas.

11. The in-spray glow discharge ionization apparatus according to claim 10, wherein the rare gas is He, Ne, Ar, Kr or Xe.

12. The in-spray glow discharge ionization apparatus according to claim 8, wherein the substance to be measured is a chemical substance which has low ionization probability, and wherein the chemical substance is an aromatic nitro compound, oxine copper, halogenated nitrobenzyl, or a polycyclic aromatic hydrocarbon.

13. The in-spray glow discharge ionization apparatus according to claim 9, wherein the dry gas is nitrogen, air, or a rare gas.

14. The in-spray glow discharge ionization apparatus according to claim 8, wherein a surface of at least one of the discharge electrodes is covered with a substance which has low oxidation state.

15. The in-spray glow discharge ionization apparatus according to claim 14, wherein the substance which has low oxidation state is gold, platinum, or silver.

16. The in-spray glow discharge ionization apparatus according to claim 8, wherein the voltage application-side discharge electrode includes a plurality of electrodes.

17. The in-spray glow discharge ionization apparatus according to claim 16, wherein each of said plurality of electrodes is a needle-shaped electrode.

18. The in-spray glow discharge ionization apparatus according to claim 16 or 17, wherein a three-dimensional actuator is provided for adjusting three-dimensional positions of the electrodes.

19. The in-spray glow discharge ionization apparatus according to claim 8, wherein electrical insulation is performed in an ion source except for the front end of the electrodes.

* * * * *